US005275932A

United States Patent [19]

Weigel et al.

[11] Patent Number: 5,275,932

[45] Date of Patent: Jan. 4, 1994

[54] THERMAL DEVELOPMENT ACCELERATORS FOR THERMOGRAPHIC MATERIALS

[75] Inventors: David C. Weigel, White Bear Lake; Oanh V. Pham, Maplewood, both of Minn.

[73] Assignee: Minnesota Mining and Manufacturing Company, Saint Paul, Minn.

[21] Appl. No.: 918,555

[22] Filed: Jul. 22, 1992

Related U.S. Application Data

[63] Continuation-in-part of Ser. No. 851,843, Mar. 16, 1992, abandoned.

[51] Int. Cl.[5] ..... G03C 1/494

[52] U.S. Cl. ..... 430/617; 430/203; 430/523; 430/600; 430/613; 430/620

[58] Field of Search ..... 430/617, 600, 964, 620, 430/613, 523, 536, 203

[56] References Cited

U.S. PATENT DOCUMENTS

| | | | |
|---|---|---|---|
| 2,910,377 | 10/1959 | Owen | 117/36 |
| 3,080,254 | 3/1963 | Grant | 117/36.8 |
| 3,787,351 | 1/1974 | Olson | 260/40 R |
| 3,847,612 | 11/1974 | Winslow | 96/67 |
| 4,585,734 | 4/1986 | Weigel | 430/619 |
| 4,668,406 | 5/1987 | Chang | 252/8.75 |
| 4,770,989 | 9/1988 | Konamura et al. | 430/620 |
| 5,041,353 | 8/1991 | Takeda | 430/617 |
| 5,149,620 | 9/1992 | Simpson et al. | 430/617 |

*Primary Examiner*—Charles L. Bowers, Jr.
*Assistant Examiner*—Thorl Chea
*Attorney, Agent, or Firm*—Gary L. Griswold; Walter N. Kirn; Gregory A. Evearitt

[57] ABSTRACT

Thermal recording material containing a suitable substrate coated with an image forming layer. The image forming layer contains a thermally reducible source of silver, a 3-indazolinone or urea compound; a polymeric binder; and optionally, an auxiliary reducing agent and toner. Preferably, an anti-stick layer is coated on top of the imaging layer.

The 3-indazolinone and urea compounds have been found to enhance the thermal image forming capability of thermal recording material.

17 Claims, No Drawings

THERMAL DEVELOPMENT ACCELERATORS FOR THERMOGRAPHIC MATERIALS

This application is a continuation-in-part application of U.S. application Ser. No. 7/851,843, filed Mar. 16, 1992, now abandoned.

FIELD OF THE INVENTION

This invention relates to a thermographic material and more particularly, it relates to the use of 3-indazolinones and urea compounds in a thermographic material to enhance the image forming capability of the thermographic material.

BACKGROUND OF THE INVENTION

As is widely known in the imaging arts, a thermographic imaging process relies on the use of heat to help produce an image. Typically, a thermally sensitive image forming layer is coated on top of a suitable base or substrate material such as paper, plastics, metals, glass, and the like. The resulting thermographic construction is then heated at an elevated temperature, typically in the range of about 60°-225° C., resulting in the formation of an image. Many times, the thermographic construction is brought into contact with the thermal head of a thermographic recording apparatus, such as a thermal printer, thermal facsimile, and the like. In such instances, an anti-stick layer is coated on top of the imaging layer in order to prevent sticking of the thermographic construction to the thermal head of the apparatus utilized.

Thermographic materials whose image forming layers are based on silver salts of long chain fatty acids, such as silver behenate, are known. At elevated temperatures, silver behenate is reduced by a reducing agent for silver ion such as hydroquinone, substituted hydroquinones, hindered phenols, catechol, pyrogallol, methyl gallate, leuco dyes, and the like, whereby an image is formed.

It is also known that other additives can be added to imaging layers of thermographic constructions to enhance their effectiveness. For example, U.S. Pat. No. 2,910,377 discloses that the silver image for such materials can be improved in color and density by the addition of toners to the imaging layer. Toners which give primarily image density enhancement are also referred to as development accelerators.

U.S. Pat. No. 3,080,254 discloses the use of phthalazinone as a toner in heat-sensitive copying paper. U.S. Pat. No. 3,847,612 discloses an improved imaging system containing an imidazole in combination with phthalic acid and the like. Phthalazine in combination with phthalic acid and other organic acids also provide an improvement in image formation. Such disclosed combinations are particularly valuable when relatively weak reducing agents, such as hindered phenols, are used as the developer for silver soaps.

U.S. Pat. No. 4,585,734 discloses the achievement of good toning when a combination of phthalazine and an active hydrogen-containing heterocyclic compound such as phthalimide, naphthalimide, pyrazole, and succinimide are employed in dry silver imaging systems.

Imaging systems which contain active ingredients that increase the thermal sensitivity and image forming capabilities of thermographic constructions are continuously needed in the imaging arts.

SUMMARY OF THE INVENTION

In accordance with the present invention, it has now been discovered that the addition of certain 3-indazolinone or urea compounds to the imaging system of a thermographic construction or thermal recording material greatly increases its imaging efficiency. The addition of the foregoing compounds provides higher image density for a given thermal development time as compared to thermographic imaging systems which do not contain these compounds.

Thus, the present invention provides a thermal recording material comprising a base or support coated with an imaging layer, the imaging layer comprising: (a) a thermally reducible source of silver; (b) at least one compound selected from the group consisting of:

(i) a 3-indazolinone compound of the formula:

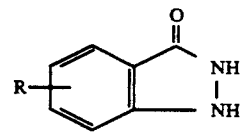

wherein: R is selected from the group consisting of: hydrogen; an alkyl group of 1 to 4 carbon atoms; halogen; and $-R^1COOH$ where $R^1$ is a $C_1$ to $C_4$ alkyl group; and (ii) a urea compound of the formula:

$$R^2-NH-\overset{\overset{\displaystyle O}{\|}}{C}-NH-R^3$$

wherein: $R^2$ and $R^3$ each independently represent hydrogen; a $C_1$ to $C_{10}$ alkyl or cycloalkyl group; or a phenyl group; or wherein $R^2$ and $R^3$ together form a heterocyclic group containing up to 6 ring atoms; and (c) a polymeric binder. In a preferred embodiment, the imaging layer also comprises an auxiliary reducing agent for the thermally reducible source of silver in addition to the 3-indazolinone or urea compounds which also functions as a reducing agent for silver ion, e.g., hindered phenols, catechol, pyrogallol, methyl gallate, hydroquinone, substituted hydroquinones, leuco dyes, and the like, as well as a toner. In another preferred embodiment, the thermal recording material further comprises an anti-stick layer positioned on top of the imaging layer.

As indicated above, the addition of 3-indazolinone and urea compounds to thermographic constructions enhances applications which require improved thermal sensitivity in order to provide reduction of thermal energy demands or increased recording speed during the image forming process.

Other aspects, advantages, and benefits of the present invention are apparent from the detailed disclosure, the examples, and the claims.

DETAILED DESCRIPTION OF THE INVENTION

In the present invention, the image forming layer comprises a thermally reducible source of silver. The latter are materials, which in the presence of a reducing agent for silver ion, undergo reduction at elevated temperatures, e.g., 60°-225° C. Preferably, these materials are silver salts of long chain carboxylic acids ("fatty acids") containing 10 to 30 and more preferably, 10 to 28 carbon atoms, e.g., silver behenate. The latter are also known in the art as "silver soaps." Complexes of organic or inorganic silver salts wherein the ligand has a gross stability constant between 4.0–10.0 can also be used. Preferably, the silver source material should constitute from about 5–50 percent by weight of the image forming system and most preferably, from about 10–30 percent by weight.

The 3-indazolinone compounds which can be used in the present invention have the following structure:

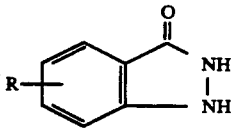

wherein: R is selected from the group consisting of: hydrogen; an alkyl group of 1 to 4 carbon atoms; halogen; —COOH; and —$R^1$COOH wherein $R^1$ is a $C_1$ to $C_4$ alkyl group. Preferably, R is hydrogen, an alkyl group with 1 to 4 carbon atoms and or —COOH and most preferably, R is hydrogen.

As is well understood in this area, a large degree of substitution is not only tolerated, but is often advisable. As used throughout this application, the term "group" is intended to refer not only to pure hydrocarbon chains or structures such as methyl, ethyl, cyclohexyl, and the like, but also to such chains or structures bearing conventional substituents in the art such as hydroxy, alkoxy, phenyl, halo (F, Cl, Br, I), cyano, nitro, amino, etc.

Such 3-indazolinone compounds can be synthesized according to procedures well known to those skilled in the art of synthetic organic chemistry. Additionally, such materials are commercially available, such as from Aldrich Chemical Company of Milwaukee, Wis.; Lancaster Chemical Company of Windham, N.H.; and K & K laboratories of Cleveland, Ohio.

Urea compounds which can be used in the present invention have the following formula:

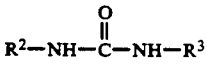

wherein: $R^2$ and $R^3$ each independently represent hydrogen; a $C_1$ to $C_{10}$ alkyl or cycloalkyl group; or phenyl; or $R^2$ and $R^3$ may together form a heterocyclic group containing up to 6 ring atoms. Preferably $R^2$ and $R^3$ represent hydrogen; a $C_1$ to $C_5$ alkyl group; phenyl, or $R^2$ and $R^3$ together from a heterocyclic group containing up to 5 ring atoms.

Non-limiting examples of urea compounds which may be used in the present invention include:

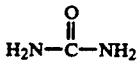

(urea)

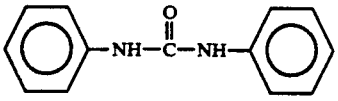

(Carbanilide or 1,3-diphenyl urea)

-continued

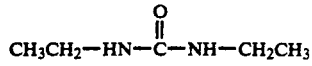

(1,3-diethyl urea)

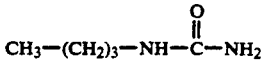

(butyl urea)

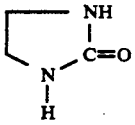

(ethylene urea or 2-imidazolidone)

The urea compounds utilized in the present invention are all known and can be made by procedures well known to those skilled in the art of synthetic organic chemistry. Alternatively, they are commercially available.

The 3-indazolinone or urea compounds are preferably present in an amount in the range of about 0.2–1.0 weight percent, and more preferably about 0.4–0.8 weight percent, based upon the total weight of the imaging layer.

The image forming layer utilized in the present invention also employs a binder. Any conventional polymeric binder known to those skilled in the art can be utilized. For example, the binder may be selected from any of the well-known natural and synthetic resins such as gelatin, polyvinyl acetals, cellulose acetate, polyolefins, polyesters, polystyrene, polyacrylonitrile, polycarbonates, and the like. Copolymers and terpolymers are, of course, included in these definitions, examples of which, include but are not limited to, the polyvinyl acetals, such as polyvinyl butyral and polyvinyl formal, and vinyl copolymers. Preferably, the binder should be present in the imaging layer in an amount in the range of 15–60 weight percent, and more preferably 25–50 weight percent, based upon the total weight of the imaging layer.

As disclosed earlier herein, the 3-indazolinone and urea compounds function as thermally sensitive reducing agents, and more specifically as development accelerators, for the thermally sensitive reducible source of silver. In a preferred embodiment of the present invention, auxiliary reducing agents which are also thermally sensitive are utilized. Such reducing agents are well known in the art and include, but are not limited to, phenols, hindered phenols, catechol (1,2-dihydroxybenzene), pyrogallol (1,2,3-trihydroxybenzene), methyl gallate, hydroquinone, substituted hydroquinones, ascorbic acid, ascorbic acid derivatives, and leuco dyes. When utilized, the auxiliary reducing agent is preferably present in the imaging layer in an amount in the range of 2–10 weight percent, and more preferably 6–8 weight percent, based upon the total weight of the image forming layer.

The use of conventional toners such as phthalazinone, phthalazine, and phthalimide can also be used in the image forming layer, if desired. When utilized, the toner should preferably be present in the forming layer in an amount in the range of 1–6 weight percent and more preferably, 2–5 percent, based upon the total weight of the imaging layer.

Any suitable base or substrate material known to those skilled in the art can be used in the present invention. Such materials can be opaque, translucent, or transparent. Commonly employed base or substrate materials utilized in the thermographic arts include, but are not limited to, paper; opaque or transparent polyester and polycarbonate films; and specularly light reflective metallic substrates such as silver, gold, and aluminum. As used herein, the phrase "specularly light reflecting metallic substrates" refers to metallic substrates, which when struck with light, reflect the light at a particular angle as opposed to reflecting the light across a range of angles.

In a preferred embodiment of the present invention, an anti-stick layer, positioned on top of the image forming layer, is used. As is known in the art, such materials are used to prevent sticking of a thermographic construction to thermal printheads and the like. Any conventional anti-stick material may be employed in the present invention. Examples of such anti-stick materials, include, but are not limited to waxes, silica particles, styrene-containing elastomeric block copolymers such as styrene-butadiene-styrene, styrene-isoprene-styrene, and blends thereof with such materials as cellulose acetate, cellulose acetate butyrate, and cellulose acetate propionate. Also useful are ethylene-vinyl acetate copolymer and chlorotrifluoroethylene/vinylidene fluoride/hexafluoropropylene terpolymer.

The imaging and anti-stick layers employed in the present invention can be applied by any method known to those skilled in the art such as knife coating, roll coating, dip coating, curtain coating, hopper coating, etc.

The following non-limiting examples further illustrate the present invention.

EXAMPLE 1

A thermally sensitive coating was prepared by mixing 82 g of silver behenate full soap (10 weight % solids) in 80 weight % methyl ethyl ketone and 20 weight % toluene with an additional 100 g of methyl ethyl ketone. 30 g of Butvar ® B-76 polyvinyl butyral (available from Monsanto Chemical Co.) was dissolved in the dispersion. The resulting dispersion was then used in Examples 2–5.

EXAMPLE 2

Sample A: To 15 g of the dispersion of Example 1 were added: 0.3 g of methyl gallate and 0.1 g of phthalazinone.

Sample B: To 15 g of the dispersion of Example 1 were added: 0.3 g of methyl gallate, 0.1 g of phthalazinone, and 0.1 g of 3-indazolinone.

Samples A and B were each coated on an opaque polyester base at 4 mil wet thickness and dried 5 min. at 60° C. An anti-stick topcoat composed of 10 g cellulose acetate dissolved in 200 g of methyl ethyl ketone was coated at 3 mil wet thickness and dried 5 min. at 60° C. This construction was then imaged on a thermal recorder at 205° C. for 25 μsec. Sample A gave a $D_{max}$ of 2.06 and a $D_{min}$ of 0.4. Sample B gave a $D_{max}$ of 2.37 and a $D_{min}$ of 0.04.

Sample C: To 15 g of the dispersion of Example 1 was added: 0.3 g of 3-indazolinone. Sample C was coated in the same manner as Samples A and B. Sample C gave a brown image with a $D_{max}$ of 0.66 and a $D_{min}$ of 0.05.

EXAMPLE 3

To 15 g of the dispersion of Example 1 were added:

Sample A: 0.35 g of methyl gallate, 0.1 g of phthalazine, and 0.1 g of 3-indazolinone.

Sample B: 0.35 g of methyl gallate, 0.1 g of phthalimide and 0.1 of 3-indazolinone.

The dispersions were coated at 4 mil wet thickness on opaque polyester base and dried 5 min. at 60° C. A anti-stick topcoat consisting of 10 g of cellulose acetate, 6.0 g of hexadecanol, and 200 g of methyl ethyl ketone was coated at 2 mil wet thickness and dried 5 min. at 60° C. Imaging on a thermal recorder at 205° C. for 25 μsec produced a $D_{max}$ of 2.04 and a $D_{min}$ of 0.04 on Sample A. Sample B gave a $D_{max}$ of 1.87 and a $D_{min}$ of 0.04.

EXAMPLE 4

To 15 g of the dispersion of Example 1 were added 0.2 g of catechol, 0.1 g of phthalazinone and 0.1 g of 3-indazolinone. This was coated at 4 mil wet thickness on opaque polyester base and dried 5 min. at 60° C. An anti-stick topcoat of 10 g cellulose acetate, 4 g of hexadecanol, 0.25 g of hexamethylene diisocyanate (Mobay N-100), and 200 g of methyl ethyl ketone was coated at 2 mil wet thickness and dried 5 min. at 60° C. Imaging on a thermal recorder at 205° C. for 25 μsec. produced a black image, $D_{max}$ 2.60 and $D_{min}$ 0.05.

EXAMPLE 5

To 15 g of the dispersion of Example 1 were added 0.3 g of methyl gallate, 0.05 g of phthalazinone, and 0.1 g of 4-carboxylic-3-indazolinone. This was coated at 4 mil wet thickness on a clear polyester film and dried 5 min. at 60° C. A topcoat of 15 g of Kraton TM D1101 styrene-butadiene-styrene-block copolymer dissolved in 200 g toluene was coated on the imaging layer at 3 mil wet thickness and dried 5 min. at 60° C.

Imaging on a thermal recorder at 205° C. for 25 μsec. produced a $D_{min}$ of 0.05 and a $D_{max}$ of 1.82 with a black image.

EXAMPLE 6

A thermally sensitive coating was prepared by homogenizing 160 g of silver behenate full soap (10 weight % solids) in 80 weight % methyl ethyl ketone and 20 weight % toluene. To this was added: 30 g of methanol, 30 g of cellulose acetate propionate, and 3.0 g of Butvar ® B-76 polyvinyl butyral. To 15 g of the above were added 0.5 g of methyl gallate, 0.1 g of 3-indazolinone, 0.1 g of succinimide, and 0.2 g of phthalazinone. 0.25 g of hexamethylene diisocyanate was added and the dispersion was coated at 4 mil wet thickness on opaque polyester base and dried 3 min. at 60° C. An anti-stick topcoat consisting of 10 g cellulose acetate, 4.0 g of hexadecanol, and 200 g of methyl ethyl ketone was coated at 2 mil wet thickness and dried 5 min. at 60° C. When tested, the sample gave a black image with a $D_{max}$ of 2.25 and a $D_{min}$ of 0.05.

EXAMPLE 7

A thermally sensitive coating was prepared by homogenizing 82 g of silver behenate full soap (10 weight % solids) in 80 weight % methyl ethyl ketone and 20 weight % toluene with an additional 100 g of methyl ethyl ketone. 30 g of Butvar ® B-76 polyvinylbutyral was mixed into the dispersion.

To 15 g of the above dispersion were added; 0.3 g of methyl gallate, 0.1 g of phthalazinone, and 0.1 g of 3-indazolinone. The above dispersion was coated at 4 mil wet thickness at 22° C. and dried 3 minutes at 60° C. This coating was used as the thermally sensitive imaging layer in Examples 8–12.

EXAMPLE 8

A transparentizing anti-stick layer of 30 g of Kraton TM D4141 styrene-butadiene-styrene block copolymer (available from Shell Chemical Co.) dissolved in 200 g of toluene was applied at 3 mil wet thickness onto a thermally sensitive imaging layer (as disclosed in Example 7) coated on 3 mil clear polyester film and dried for 5 minutes at 60° C. in a forced air oven.

When this construction was passed through a thermal printhead, a black image of 2.42 density with a $D_{min}$ of 0.04 was obtained. Haze measurements made on a Hunter Lab Hazemeter (Hunter Associates Laboratory, Inc., Reston, Va.) gave a reading of 6.4%.

EXAMPLE 9

15 g of Kraton TM D1101 styrene-butadiene-styrene block copolymer (available from Shell Chemical Co.) was dissolved in 100 g of toluene and 100 g of methyl ethyl ketone. 0.15 g of vinyl chloride-vinyl acetate copolymer was then added to 20 g of the above solution. The resulting transparentizing, anti-stick layer was coated at 2 mil wet thickness onto a thermally sensitive imaging layer (as disclosed in Example 7) coated on 3 mil clear polyester film and dried 5 minutes at 60° C. When this coating was passed through a thermal printhead, a black image of 2.49 $D_{max}$ and 0.04 $D_{min}$ was obtained. Hunter Lab Hazemeter measurements showed 8.7% haze.

EXAMPLE 10

15 g of Kraton TM D1101 styrene-butadiene-styrene block copolymer and 1.5 g of Styron TM 685D polystyrene (available from Dow Chemical Co.) were dissolved in 100 g of toluene and 100 g of methyl ethyl ketone. The resulting transparentizing, anti-stick layer was coated at 3 mil wet thickness onto a thermally sensitive imaging layer (as disclosed in Example 7) coated on 3 mil clear polyester film and dried 5 minutes at 60° C.

Measurements gave a 2.26 $D_{max}$ and 0.04 $D_{min}$ after being developed on a thermal printhead. Hunter Lab Hazemeter measurements showed a haze of 9.0%.

EXAMPLE 11

15 g of Kraton TM G-1650 styrene-ethylene-butylene-styrene block copolymer (available from Shell Chemical Co.) was dissolved in 100 g of toluene and 100 g of methyl ethyl ketone. The resulting transparentizing, anti-stick layer was coated at 3 mil wet thickness onto a thermally sensitive imaging layer (as disclosed in Example 7) coated on 3 mil clear polyester film and dried 5 minutes at 60° C.

Measurements gave a 2.34 $D_{max}$ and 0.04 $D_{min}$ after being developed on a thermal printhead. Hunter Lab Hazemeter measurements showed a haze of 7.0%.

EXAMPLE 12

10 g of cellulose acetate was dissolved in 200 g of methyl ethyl ketone. To the solution, 2 g of phthalazinone was added together with 75 g of toluene. 1.0 g of Kraton TM 1107 styrene-isoprene-styrene block copolymer (available from Shell Chemical Co.) was dispersed in the solution. The resulting transparentizing anti-stick layer was coated at 3 mil wet thickness on a thermally sensitive imaging layer (of Example 7) coated on 3 mil clear polyester film and dried at room temperature 22° C. for 10 minutes.

A black image on passing through the printer had a $D_{max}$ of 2.39 and a $D_{min}$ of 0.04. Hunter Lab haze value was 6.5%.

EXAMPLE 13

A dispersion of 160 g silver behenate full soap in 20 g Butvar TM B-76 was prepared. Four samples A–D were prepared by combining 15 g of the dispersion with:

| | A | B | C | D |
|---|---|---|---|---|
| L-Ascorbic acid palmitate | 0.1 g | 0.1 g | 0.1 g | 0.1 g |
| Methyl gallate | 0.6 g | 0.6 g | 0.6 g | 0.6 g |
| Succinimide | 0.2 g | 0.2 g | 0.2 g | 0.2 g |
| 2-imidazolidone | 0.1 g | | | |
| dimethyl urea | | 0.1 g | | |
| Carbanilide | | | 0.1 g | |
| MeOH | 4 ml | 4 ml | 4 ml | 4 ml |
| Methyl ethyl ketone | 1 ml | 1 ml | 1 ml | 1 ml |

The above dispersion was coated at 4 mils wet thickness and was dried for 3 min at 50° C. A topcoat consisting of 2.5 g Kel-F TM 3700 terpolymer of chlorotrifluoroethylene/vinylidene fluoride/hexafluoropropylene (available from 3M Company), 200 g acetone, and 2.0 g Fluorad TM FC-431 fluorochemical surfactant (as disclosed in U.S. Pat. Nos. 3,787,351 and 4,668,406) (3M Company) was then coated at 2 mils wet thickness over the first coating and dried for 3 minutes at 50° C. The samples were run through a thermal head (on an Oyo Geo Space GS-612 Thermal Plotter) producing the following results:

| | A | B | C | D |
|---|---|---|---|---|
| $D_{max}$ | 1.79 | 1.99 | 1.79 | 1.47 |
| $D_{min}$ | 0.08 | 0.08 | 0.08 | 0.11 |

Haze measurements made on a Hunter Lab Hazemeter produced the following:

| | A | B | C | D |
|---|---|---|---|---|
| % haze | 7% | 8% | 8% | 15% |

EXAMPLE 14

This example describes various topcoats useful for thermographic media of the invention. Solution A was prepared by combining 170 g silver behenate full soap (12 weight % solids MEK/toluene +0.5 weight % Butvar TM B-76), 100 g acetone, 25 g CA-398-6 cellulose acetate polymer (Eastman Chemical Co.), 5 g Acryloid TM A-21 methyl methacrylate polymer (Rohm & Haas), and 0.5 g Vitel TM PE 200 polyester resin (Goodyear Chemical). To 15 g of Solution A were added 0.6 g methyl gallate, 0.2 g succinimide, 0.1 g 2-imidazolidone, 0.06 g tetrachlorophthalic anhydride, 0.01 g benzotriazole, 4.5 g acetone 0.5 g methanol and the mixture was coated at 3 mils wet thickness and dried for 3 minutes at 60° C. to give coated Article A. Six samples (A–F) were prepared as follows:

Sample A: a solution of 1.25 weight % KEL-F TM 3700 and 0.5 weight % FC-431 in MEK was coated onto coated Article A.

Sample B: a solution of 2% ELVAX TM 260 ethylene-vinyl acetate copolymer (DuPont) in toluene was coated onto coated Article A.

Sample C: a solution of 1.25% in KEL-F TM 3700 and 0.25 % ELVAX TM 40W ethylene-vinyl acetate copolymer (DuPont) in MEK was coated onto coated Article A.

Sample D: same as Sample A except Solution A layer does not contain 2-imidazolidone.

Sample E: same as Sample A except Solution A layer does not contain succinimide.

Sample F: same as Sample A except Solution A layer contains 0.05 g of 2-imidazolidone.

All topcoats were at 2 mils wet thickness and were dried at 60° C. The experimental results obtained by imaging Samples A–F with a thermal print head on an Oyo Geo Space GS-612 Thermal Plotter are shown below.

| | $D_{min}$ | $D_{max}$ | Runability | Haze |
|---|---|---|---|---|
| A | .06 | 1.67 | quiet | 7% |
| B | .07 | 1.69 | quiet | 11% |
| C | .06 | 1.69 | quiet | 10% |
| D | .07 | 1.50 | quiet | 14% |
| E | .05 | 1.47 | quiet | 5% |
| F | .06 | 1.62 | quiet | 9% |

Reasonable modifications and variations are possible from the foregoing disclosure without departing from either the spirit or scope of the present invention as defined in the claims.

What is claimed is:

1. A thermal recording material comprising a substrate coated with an imaging layer, said imaging layer comprising: (a) a thermally reducible source of silver; (b) a polymeric binder; and (c) a reducing agent for said thermally reducible source of silver having the formula:

$$R^2-NH-\overset{\overset{\displaystyle O}{\|}}{C}-NH-R^3$$

wherein: $R^2$ and $R^3$ each independently represent hydrogen; a $C_1$ to $C_{10}$ alkyl or cycloalkyl group; or a phenyl group; or wherein $R^2$ and $R^3$ together form a heterocyclic group containing up to 6 ring atoms; and optionally, (d) an anti-stick layer positioned on top of said imaging layer.

2. The thermal recording material of claim 1 wherein said anti-stick layer comprises at least one styrene-containing elastomeric block copolymer.

3. The thermal recording material of claim 1 wherein said anti-stick layer is an ethylene-vinyl acetate copolymer or a chlorotrifluoroethylene-vinylidene fluoride-hexafluoropropylene terpolymer.

4. The thermal recording material of claim 1 wherein said thermally reducible source of silver is reduced at a temperature in the range of about 60°–225° C.

5. The thermal recording material of claim 1 wherein said thermally reducible source of silver is a silver salt of a carboxylic acid containing 10–30 carbon atoms.

6. The thermal recording material of claim 5 wherein said silver salt is silver behenate.

7. The thermal recording material of claim 1 wherein said thermally reducible source of silver is present in said imaging layer in an amount in the range of 5–50 weight percent, based upon the total weight of said imaging layer.

8. The thermal recording material of claim 1 wherein $R^2$ and $R^3$ each independently represent hydrogen; a $C_1$ to $C_5$ alkyl group; or phenyl, or $R^2$ and $R^3$ together form a heterocyclic group containing up to 5 ring atoms.

9. The thermal recording material of claim 1 wherein said compound in (c) is present in said imaging layer in an amount in the range of 0.2–1.0 weight percent, based upon the total weight of said imaging layer.

10. The thermal recording material of claim 1 wherein said polymeric binder is present in said imaging layer in an amount in the range of 15–60 weight percent, based upon the total weight of said imaging layer.

11. The thermal recording material of claim 1 further comprising an auxiliary reducing agent for silver ion in addition to said compound in (c).

12. The thermal recording material of claim 11 wherein said auxiliary reducing agent is present in said imaging layer in an amount in the range of 2–10 weight percent, based upon the total weight of said imaging layer.

13. The thermal recording material of claim 1 wherein said imaging layer further comprises toner.

14. The thermal recording material of claim 1 wherein said substrate is opaque.

15. The thermal recording material of claim 1 wherein said substrate is transparent.

16. The thermal recording material of claim 1 wherein said substrate is a specularly light reflecting metal.

17. A thermal recording material comprising a substrate coated with an imaging layer, said imaging layer consisting essentially of: (a) a thermally reducible source of silver; (b) a polymeric binder; and (c) a reducing agent for said thermally reducible source of silver having the formula:

$$R^2-NH-\overset{\overset{\displaystyle O}{\|}}{C}-NH-R^3$$

wherein: $R^2$ and $R^3$ each independently represent hydrogen; a $C_1$ to $C_{10}$ alkyl or cycloalkyl group; or a phenyl group; or wherein $R^2$ and $R^3$ together form a heterocyclic group containing up to 6 ring atoms.

* * * * *